United States Patent [19]

Reeve-Parker

[11] Patent Number: 4,750,716

[45] Date of Patent: Jun. 14, 1988

[54] INJECTION LANCE

[75] Inventor: Michael C. Reeve-Parker, Bewdley, England

[73] Assignee: Ashland Oil, Inc., Russell, Ky.

[21] Appl. No.: 26,325

[22] Filed: Mar. 16, 1987

[30] Foreign Application Priority Data

Apr. 4, 1986 [GB] United Kingdom ..... 8608225

[51] Int. Cl.[4] ..... C21C 5/46

[52] U.S. Cl. ..... 266/225; 266/270

[58] Field of Search ..... 266/225, 270

[56] References Cited

U.S. PATENT DOCUMENTS 1,793,849 2/1931 Groninger ..... 266/270

4,048,352 9/1977 Pignocco et al. ..... 266/270

FOREIGN PATENT DOCUMENTS 2819714 11/1979 Fed. Rep. of Germany ..... 266/225

*Primary Examiner*—L. Dewayne Rutledge

*Assistant Examiner*—Robert L. McDowell

*Attorney, Agent, or Firm*—David L. Hedden

[57] ABSTRACT

An injection lance is provided for introducing flux mixtures and the like into baths of molten metal, which lance has inner and outer spaced metal tubes with between them a tubular sheath of refractory material that is spaced from both the inner and outer tubes by air gaps. The outer tube may be of high temperature metal with a refractory coating. The tubes can be maintained in coaxial relationship by an end cap at the inlet end of the lance and by rammed ceramic fibre insulation introduced at both ends, the outer tube at the discharge end being chamfered and containing a body of rammed insulation in which the inner tube is buried, with the terminal portion of the flow passage through the lance at the discharge end being provided as a passage formed through the rammed insulation.

6 Claims, 1 Drawing Sheet

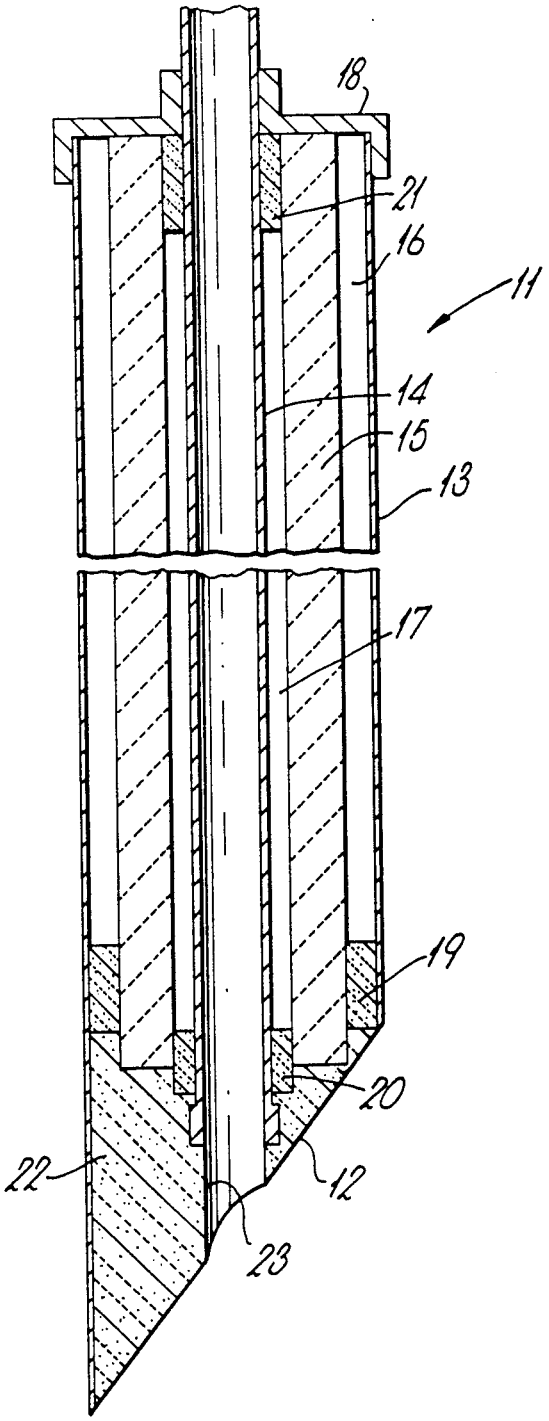
18
21
16
11
14
15
13
17
19
20
22
12
23

INJECTION LANCE

This invention relates to injection lances for the introduction of chemical substances into baths of molten metal. An example is the injection of a drossing-off flux into molten aluminium or its alloys.

When fluxes consisting of appropriate mixtures of chloride and fluoride salts are introduced into molten aluminium or aluminium alloys, a series of chemical reactions take place and as a result the alloy is cleansed of non-metallic inclusions, and degassed (hydrogen is removed). The resultant oxide dross on the surface of the melt contains only a very small amount of entrapped aluminium metal. The preferred method of introduction is to inject the substances of the flux mixture, in a stream of inert gas such as nitrogen, directly beneath the surface of the molten metal by means of an injection lance.

The flux injection lances available at the present time are usually made of:

(1) cast iron;

(2) mild steel;

(3) mild steel clad with ceramic fibre;

(4) graphite-silicon carbide or graphite alone.

Each of the above materials suffers from serious disadvantages. The materials all possess relatively high thermal conductivity and the internal temperature of the lance reaches equilibrium with the molten metal in which it is immersed, usually at a level about 30° C. below the metal temperature, during the time taken for flux injection (10 to 15 minutes). Lances constructed from mild steel or cast iron, if not coated with a suitable refractory coating, will actually lose material into solution in the aluminium alloy, thereby undesirably increasing the iron content of the aluminium alloy which can give rise to excessive shrinkage and, in extreme cases, render the alloy out of specification.

Moreover, the high internal temperature of the lance imposes severe restrictions on the formulation and effectiveness of the injected flux, in that the melting or fusion point of the flux mixture may need to be selected at an otherwise disadvantageously high temperature solely in order to try and prevent the flux fusing in the lance. As soon as the flux starts to fuse in the lance a blockage will occur in an extremely short time, thereby requiring the lance to be withdrawn from the melt, either to be unblocked, which can take several minutes, or to be replaced with another lance which, if made from the same material, could itself then block. However, raising the flux fusion point temperature to prevent this happening tends to restrict the effectiveness of the flux mixture being used since, in general, the higher the fusion point of the flux the lower is the chemical reactivity, and the more limited the scope of the possible beneficial chemical functions of the flux. The overall effectiveness of the drossing-off operation is thus impaired.

It is a object of the present invention to overcome these disadvantages.

According to the present invention, an injection lance is provided comprising inner and outer spaced coaxial tubes, with a thermally insulating layer or layers interposed between them, the inner tube having its extremity at the nozzle or discharge end of the lance contained within refractory material and buried some distance in from the lance nozzle opening.

By the use of such a construction, the constraint of a high internal lance temperature can be avoided. Indeed, an equilibrium with the molten alloy at a temperature of some 300° to 350° C. below that of the alloy can be achieved.

In the preferred form, the space between the inner and outer tubes contains a tubular sheath of refractory material, with air gaps provided between the refractory sheath and both the inner and outer tubes. The inner and outer tubes may be of metal, the outer tube being preferably of a high temperature metal, such as titanium alloy, and coated with an outer skin or coating of refractory material.

One arrangement in accordance with the invention will now be described by way of example with reference to the accompanying drawing, which shows an injection lance embodying the invention in diagrammatic longitudinal section.

BRIEF DESCRIPTION OF THE DRAWING

The drawing shows a lance 11 comprising an outer metallic tube 13 and a coaxial inner metallic tube 14. Coaxially disposed between the inner and outer tube is an intermediate tubular sheath of refractory material 15. There are air gaps 16, 17 between respectively, the outer metallic tube 13 and the intermediate tube 15, and the intermediate tube 15 and the inner tube 14.

DETAILED DESCRIPTION OF THE INVENTION

In the drawing, the lance 11 is one to two meters long with an obliquely sloped or chamfered end face 12 at its discharge end. It comprises an outer metallic tube 13, a coaxial inner metallic tube 14, and an intermediate refractory sheath or tube 15 disposed coaxially between the outer and inner metallic tubes, with outer and inner annular air gaps 16,17 between, respectively, the outer tube 13 and the intermediate tube 15, and the intermediate tube 15 and the inner tube 14. At the back end of the lance, the outer and intermediate tubes 13,15 terminate at a flanged end plate 18, only the inner tube 14 passing through the end plate for connection to the supply of flux mixture and inert gas.

Adjacent the discharge end of the lance, the outer annular air gap 16 is plugged with a rammed plug 19 of rammable insulating material, such as ceramic fibre insulation. The inner air gap 17 is plugged at both ends by means of plugs of insulating material 20,21 which can also be of ceramic fibre. At the discharge end, the intermediate tube or sheath 15 is square-ended, as is also the inner tube 14 which projects somewhat beyond the intermediate tube 15 and the end plug 20 closing the air gap 17, but the end of the outer tube 13 is cut on the chamfer and to build up the nozzle of the lance the interior of this chamfered end is filled with rammable insulaton 22, which again can be ceramic fibre insulation. The end of the inner tube 14 is entirely sheathed by this rammed insulation 22 and, if desired, the tube end can be somewhat enlarged and threaded or serrated to provide an effective key between the insulation and the tube end.

The construction is such that the extreme end of the inner metal tube 14 is buried some 5 to 30 mm within the refractory material 22, the terminal portion 23 of the bore through which the flux mixture discharges into the molten metal bath being formed by the rammed refractory material. This is to prevent the heat of the molten metal being conducted along the inner tube. The material of the inner tube is not critical and it can be of mild steel.

The inner air gap 17 around the inner tube 14 may be, say, 3 to 5 mm. The intermediate refractory tube or sheath 15, which may be, say, 28 to 30 mm in diameter, can be constructed using a variety of refractory materials, such as ceramic fibre, or ceramic fibre paper rolled into a tube, foamed refractory or a refractory aggregate, perlite, vermiculite, and so forth. So long as the sheath is strong enough to be self-supporting under the forces transmitted to it during use of the lance, mechanical robustness is not a prime requirement since it is protected by the inner and outer tubes. The outer air gap 16 surrounding the sheath 15 may be, say, 10 to 12 mm.

The outer metal tube 13 has a protective refractory coating applied to it by either plasma- or flame-spraying. The metal itself can be mild or stainless steel, a cupro-nickel or nimonic alloy, titanium or a titanium alloy, zirconium or tantalum; but the preferred material is a temperature-resistant or refractory metal such as titanium alloy. The refractory coating on the metal should have a thermal coefficient of expansion compatible with that of the metal or alloy on to which it is sprayed, and it should also be chemically compatible with the molten metal in which the lance is to be immersed. Some ceramic coatings that have a similar coefficient of expansion to that of titanium and its alloys, and could be suitable for immersion into molten aluminium alloys, are as follows:

| | |
|---|---|
| $Al_2O_3$—MgO Spinel; | $CrO_3$; |
| $CeO_2$; | $ZrO_2$—SrO; |
| $TiO_2$—SrO; | $2TiO_2$—MgO; |
| $Cr_2O_3$—MnO; | $Cr_2O_3$—FeO; |
| $Al_2O_3$—$TiO_2$ NiO; | $Al_2O_3$—NiO; |
| $Al_2O_3$—CoO; | $TiO_2$; |
| Zr; | Nb; |
| TiC; | $Cr_3C_2$ 86.6% Cr; |
| $Al_2O_3$—ZnO; | $Al_2O_3$. |

By the use of an injection lance according to this invention, the internal lance temperature is readily kept down to a level at which a flux mixture with a comparatively low fusion temperature, say around 580° C., can be injected into molten metal at a considerably higher temperature, around 750° C. for molten aluminium, without risk of blocking the lance. Using one of the lances available hitherto, blocking would have taken place under these conditions within three to four minutes. The accompanying Table shows the results of temperature trials using our improved lance.

As a consequence, the range of metal treatments possible has been expanded as follows:

(a) degassing (removal of $H_2$);
(b) removal of non-metallic inclusions ($Al_2O_3$, MgO etc.);
(c) grain refinement with Ti-B-Zr-P;
(d) modification of Al Si alloys 11 to 13% (Na);
(e) refinement of aluminium and silicon alloys 15–25%;
(f) removal of magnesium, sodium, calcium from Al alloys, separately or combined;
(g) flux washing with very low melting point flux mixes.

TEMPERATURE TRIALS
METAL TEMPERATURE AT START 760° C. FINISH 740° C.

| Time Secs. | Temp. °C. | Time Secs. | Temp. °C. | Time Secs. | Temp. °C. | REMARKS |
|---|---|---|---|---|---|---|
| 0 | 17 | 10 | 200 | 20 | 336 | Temperature was |
| 10 | 38 | 20 | 206 | 30 | 339 | measured using |
| 20 | 42 | 30 | 213 | 40 | 342 | C.Al-Alumel T/C |
| 30 | 47 | 40 | 220 | 50 | 344 | down centre tube |
| 40 | 51 | 50 | 226 | 11.00 | 347 | 1½–2 inches from |
| 50 | 56 | 6.00 | 232 | 10 | 348 | bottom of lance. |
| 1.00 | 60 | 10 | 239 | 20 | 350 | Normal duration |
| 10 | 63 | 20 | 245 | 30 | 349 | of test is |
| 20 | 67 | 30 | 251 | 40 | 348 | 10 minutes. |
| 30 | 70 | 40 | 257 | 50 | 353 | |
| 40 | 73 | 50 | 263 | 12.00 | 362 | |
| 50 | 76 | 7.00 | 269 | 10 | 367 | |
| 2.00 | 79 | 10 | 275 | 20 | 370 | |
| 10 | 81 | 20 | 280 | 30 | 372 | |
| 20 | 85 | 30 | 285 | 40 | 374 | |
| 30 | 90 | 40 | 291 | 50 | 375 | |
| 40 | 95 | 50 | 296 | 13.00 | 377 | |
| 50 | 102 | 8.00 | 300 | | | |
| 3.00 | 108 | 10 | 304 | | | |
| 10 | 115 | 20 | 307 | | | |
| 20 | 123 | 30 | 312 | | | |
| 30 | 130 | 40 | 316 | | | |
| 40 | 137 | 50 | 319 | | | |
| 50 | 144 | 9.00 | 322 | | | |
| 4.00 | 151 | 10 | 325 | | | |
| 10 | 159 | 20 | 327 | | | |
| 20 | 165 | 30 | 329 | | | |
| 30 | 172 | 40 | 331 | | | |
| 40 | 179 | 50 | 331 | | | |
| 50 | 186 | 10.00 | 332 | | | |
| 5.00 | 192 | 10 | 334 | | | |

I claim:

1. An injection lance for the introducton of chemical substances into a bath of molten metal, comprising inner and outer spaced coaxial tubes (a) said inner tube having entrance and discharge ends wherein the ends form openings such that said chemical substances pass through the entrance of the inner tube to the discharge end of the lance, and
(b) and intermediate tubular sheath of refractory material coaxially disposed between the outer and inner tubes, with outer and inner air gaps between, respectively, the outer tube and intermediate tube, and the intermediate tube and the inner tube.

2. A lance according to claim 1 wherein the outer tube is of high temperature metal and has an outer refractory coating.

3. A lance according to claim 2 wherein the gap between the refractory sheath and the inner tube is plugged at both ends with insulating material.

4. A lance according to claim 3 wherein the end of the outer tube at the discharge end of the lance is cut to a chamfer and the chamfered end of this tube contains a filling or rammed refractory material which surrounds the inner tube.

5. A lance to claim 4 wherein the rammed refractory materials is composed of ceramic fibers.

6. A lance according to claim 5 wherein the inlet end of the outer tube of the lance is closed by a flanged end cap having a central aperture through which the inner tube passes.

* * * * *